US005276739A

United States Patent [19]

Krokstad et al.

[11] Patent Number: 5,276,739

[45] Date of Patent: Jan. 4, 1994

[54] PROGRAMMABLE HYBRID HEARING AID WITH DIGITAL SIGNAL PROCESSING

[75] Inventors: Asbjorn Krokstad; Jarle Svean, both of Trondheim; Tor A. Ramstad, Saupstad, all of Norway

[73] Assignee: NHA A/S, Stabekk, Norway

[21] Appl. No.: 852,242

[22] PCT Filed: Nov. 29, 1990

[86] PCT No.: PCT/NO90/00178

§ 371 Date: May 26, 1992

§ 102(e) Date: May 26, 1992

[87] PCT Pub. No.: WO91/08654

PCT Pub. Date: Jun. 13, 1991

[30] Foreign Application Priority Data

Nov. 30, 1989 [NO] Norway ..... 894806

[51] Int. Cl.[5] ..... H04R 25/00

[52] U.S. Cl. ..... 381/68.2; 381/68.4

[58] Field of Search ..... 381/68.2, 68.4, 68.6

[56] References Cited

U.S. PATENT DOCUMENTS 4,750,207 7/1988 Gebert ..... 381/68.2

4,947,432 8/1990 Topholm ..... 381/68.4

*Primary Examiner*—Jin F. Ng

*Assistant Examiner*—Sinh Tran

*Attorney, Agent, or Firm*—Poms, Smith, Lande & Rose

[57] ABSTRACT

Programmable hybrid hearing aid with digital signal processing comprising a main section (1) which can be inserted in the meatus (6). The main section (1) comprises an open connection between the ear opening and an inner portion of the meatus (6), providing an acoustic transmission channel with low-pass characteristic and resonant amplification. The main section further comprises an electroacoustic transmission channel based on digital signal processing and a signal processor (DSP) and with possibility for suppressing a possible acoustic signal feedback through the acoustic transmission channel. A variant of the hearing aid is provided with a microphone (M1) and the feedback signal is suppressed by digital filtering. Another variant of the hearing aid employs two microphones (M1.M2). and the feedback signal may then be suppressed by phasing out before the digital signal processing, while the digital signal processing also comprises cancellation of the feedback signal in case of high gain. A number of response functions are stored in a memory (RAM2) in a control unit and is freely chosen by the user in regard of adaption to hearing function and acoustic environment. All the electronics of the electroacoustic channel in the hearing aid is implemented as a monolithic integrated circuit (3) in CMOS technology.

45 Claims, 7 Drawing Sheets

I a, b STRONG HEARING IMPAIRMENT, UPPER: TOTAL, LOWER: ACOUSTIC CHANNEL

II a, b MODERATE HEARING IMPAIRMENT, UPPER: TOTAL, LOWER: ACOUSTIC CHANNEL

III a, b WEAK HEARING IMPAIRMENT, UPPER: TOTAL, LOWER: ACOUSTIC CHANNEL

IV SOUND PRESSURE RESPONSE OF MEATUS WITHOUT HEARING AID

PROGRAMMABLE HYBRID HEARING AID WITH DIGITAL SIGNAL PROCESSING

BACKGROUND OF THE INVENTION

The invention concerns a programmable hybrid hearing aid with digital signal processing and a method for detection and signal processing in a programmable hybrid hearing aid.

Present day hearing aids are usually based on analog amplification of the sound intercepted by the ear. With the aid of present day state of the art, hearing aids of this kind have become miniaturized to such an extent that they can be inserted into the outer meatus, thus constituting so-called "all-in-the-ear" aids. Many people prefer hearing aids of this type for reasons of appearance and comfort, but the use of analog amplification of the sound signal combined with the fact that these hearing aids close off the meatus, make it difficult to obtain an optimum adaptation of the signal to any hearing residue which the person using the hearing aid may still have. Most forms of age-dependent hearing impairment leave a substantial amount of hearing residue in certain frequency ranges. In the case of normal neurologically-dependent hearing impairment the sense of hearing usually remains relatively unimpaired at the lowest frequencies. If the ear is completely closed by the hearing aid, the sound has to be amplified at all frequencies in the audible range. At the same time, the use of ordinary analog amplification makes it difficult to obtain an optimum response function, i.e. a response function which in an appropriate manner simulates the acoustic response of the meatus when it is open without insertion amplification. Any hearing residue which the user may have will result in the amplification in an all-pass band giving rise to discomfort, e.g. if impulse noise and transient acoustic signals are amplified in those frequency bands where the ear still has a reasonably normal degree of hearing. Moreover, an open meatus normally has a resonance of approximately 3 kHz, and this resonance makes a vital contribution to the quality of the auditory impression, since it falls within the range of the formant frequency for normal speech and thus contributes to giving it its tonal qualities, which are tremendously important for the comprehension of speech sound and thus for the person's ability to understand speech.

In order to facilitate the optimum adaptation of the auditory signal to any hearing residue and simultaneously optimize the hearing aid's response function, hearing aids have been developed wherein the signal processing is performed digitally. The response function is adapted through filtering of the digital signal by means of appropriate filter coefficients, thus permitting the frequency response to some extent to simulate the response function of a person with normal hearing. If the aids of the digital type are designed as so-called all-in-the-ear aids, the problem again arises that the meatus is closed, thus preventing any hearing residue which the person may have from being utilized. The response curve can be modified to a certain extent in order to take this into consideration. As a rule, however, it will be an advantage to have several response curves, in order to adapt the hearing aid's amplification as a function of the frequency to a variety of acoustic environments. It is obvious, e.g., that it would be considerably more difficult to understand normal speech which is embedded in loud background noise, in which case it will be natural to generate a response function which gives priority to amplification in the range of the speech signal's formant frequencies, i.e. primarily in the range from approximately 1 up to approximately 4 kHz.

Another well-known problem with hearing aids, whether they are digital or analog, is acoustic feedback between sound generator and microphone. Even though the hearing aid is positioned so that it closes the meatus and thus also prevents utilization of any hearing residue, this does not prevent feedback at high amplification, since the sound from the sound generator can be conducted back to the microphone either via the material of the hearing aid or via tissue and bone matter in the vicinity of the meatus. It will therefore be desirable to cancel such a feedback signal, e.g. in connection with the digital signal processing in the hearing aid. As has already been mentioned it is also desirable to utilize any hearing residue at lower frequencies, and this requires the meatus to be at least partially open, preferably so that it creates an acoustic transmission channel with a low-pass characteristic between the ear opening and the tympanum. If a channel of this kind is to be used with a hearing aid of the all-in-the-ear type, this makes great demands on the miniaturization of the hearing aid. Moreover, the problem of acoustic feedback will be further accentuated and will need to be eliminated in one way or another.

Digital hearing aids of the above-mentioned kind are known from, e.g., U.S. Pat. No. 4,471,171 (Köpke et al.), where a digital data processor for processing of digitalized audio signals is connected to a programmable memory which stores predetermined response functions in accordance with the user's requirements or preferences and/or the use of the hearing aid, so that the use of the hearing aid can be directly adapted to the requirements of the user, while at the same time it is possible to program the hearing aid in step with any alterations in the user's hearing ability or response characteristics.

Similarly, U.S. Pat. No. 4,731,850 (Levit et al.) contains a programmable hearing aid with digital filters where coefficients are supplied from a programmable read-only memory to a programmable filter and an amplitude limiter in the hearing aid, enabling this to be automatically adjusted to an optimum set of parameter values for speech level, echo and type of background noise while simultaneously facilitating a reduction of acoustic feedback, in that an electrical feedback path in the aid is adapted to the acoustic feedback path both in amplitude and phase, causing the two feedback signals to be cancelled by subtraction. GB-PS no. 1 582 821 principally contains a hearing aid for digital signal processing by means of a programmable memory which can be fed with values taken from an audiometrically determined audiogram.

The above-mentioned U.S. Pat. No. 4,731,850 also contains a hearing aid which uses one or more microphones, so that the weighted, summed output signal from the microphones with a suitable phase displacement is equal to the output signal from a frequency selective, directive microphone. This should be able to reduce the effect of both noise and echo. Furthermore, cancellation or suppression of acoustic feedback in hearing aids is discussed in the article "Measurement and Adaptive Suppression of Acoustic Feedback in Hearing Aids" (Bustamante et al.), IEEE Transactions on Acoustics, Speech and Signal Processing, 1989, No. 2, pp. 2017–20. The authors discuss three methods for suppressing acoustic feedback, viz. time-variable delay, adaptive inverse filtering and adaptive feedback cancellation, and find that the latter method is the most successful, since it increases the maximum amplification in the hearing aid by 6–10 dB without acoustic feedback.

It should also be mentioned that there are known hearing aids of the all-in-the-ear type where there is an open connection between the ear opening and that portion of the inner meatus which is situated close to the tympanum. The object of this known, open connection is to obtain an equalization of pressure variations in the outer meatus adjacent to the tympanum.

None of the above-mentioned constructions or methods, however, provides any directions as to how to achieve a hearing aid, preferably of the all-in-the-ear type, which simultaneously offers the possibility of utilizing a user's low frequency hearing residue, while at the same time generating a response curve which gives an optimum simulation of the meatus's natural response function in the frequency range which is required in order to reproduce high quality speech sound.

SUMMARY OF THE INVENTION

A first object of the invention, therefore, is to provide a hearing aid which permits the utilization of a hearing residue in the bass range, where amplification of frequencies in this range at least is achieved by means of an acoustic transmission channel with resonant amplification, while at the same time an acoustic feedback through the transmission channel is cancelled.

A second object is to provide a hearing aid which gives the user the opportunity to choose between different response functions stored in the hearing aid, so that the utilized response function is the one which is best adapted to the acoustic environment in which the user finds himself at that moment.

A third object is to provide a hearing aid in which all the principal components are arranged in a module which can be inserted in the outer meatus, but simultaneously permits an open connection between the ear opening and an inner portion of the outer meatus in order to utilize a low frequency hearing residue.

A fourth object is to provide a hearing aid in which any acoustic feedback is eliminated by cancellation in a digital filter.

A fifth object is to provide a hearing aid in which the acoustic feedback is eliminated by phasing out the feedback signal by means of two microphones.

A sixth object is to provide a hearing aid in which the stored response functions can be reprogrammed in that the hearing aid is connected to a computer via an interface for input of new response functions.

The majority of the above-mentioned objects and advantages are achieved with a hearing aid which is characterized by the features presented by the characteristic part of claim 1 or claim 3. All of the above-mentioned features and advantages are achieved with a hearing aid which is characterized by the features presented by the characteristic part of claim 5.

A method for detection and signal processing in a hearing aid principally of the type presented in claim 5, is characterized by the features presented by the characteristic part of claim 13.

Further features and advantages of the hearing aid in accordance with the invention are presented in the appended independent claims 2, 4 and 6–12. Further features and advantages of the method in accordance with the invention are presented in the appended independent claims 14–21.

BRIEF DESCRIPTION OF THE DRAWINGS

The invention will be described in more detail in the following section with reference to some embodiments and in connection with the attached drawings.

DETAILED DESCRIPTION OF THE PREFERRED

Figure 1A:
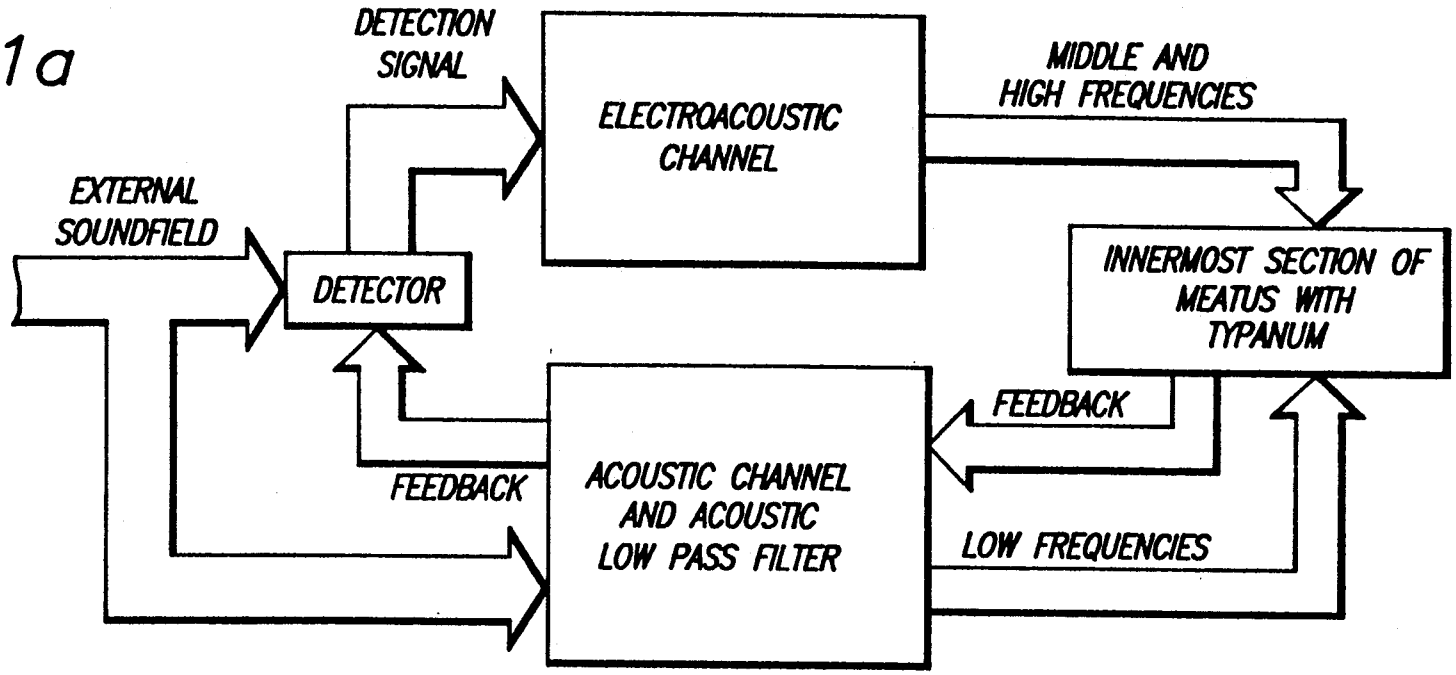
FIG. 1*a* is a block diagram showing the principles of a hearing aid in accordance with the invention.

The principles of the design of a hearing aid in accordance with the invention are illustrated schematically in FIG. 1*a*. The hearing aid comprises an electroacoustic channel consisting of an analog input section, a digital signal processor and an analog output section together with an acoustic transmission channel which simultaneously constitutes both an acoustic low-pass filter and a potential acoustic feedback path. An external sound field is detected by a detector, in practice a microphone, and delivers a detection signal to an electro-acoustic channel which then transfers audio signals on middle and high frequencies to an inner portion of the outer meatus and the tympanum. The external sound field is also detected by the acoustic channel and delivers acoustic signals on low frequencies to the inner section of the outer meatus and the tympanum. The sound field which is generated in this inner section of the outer meatus can be fed back to the detector via its acoustic channel. The method of construction of the hearing aid causes a section of the inner meatus near the tympanum also to constitute an active component of the hearing aid by acting as a resonator.

Figure 1B:
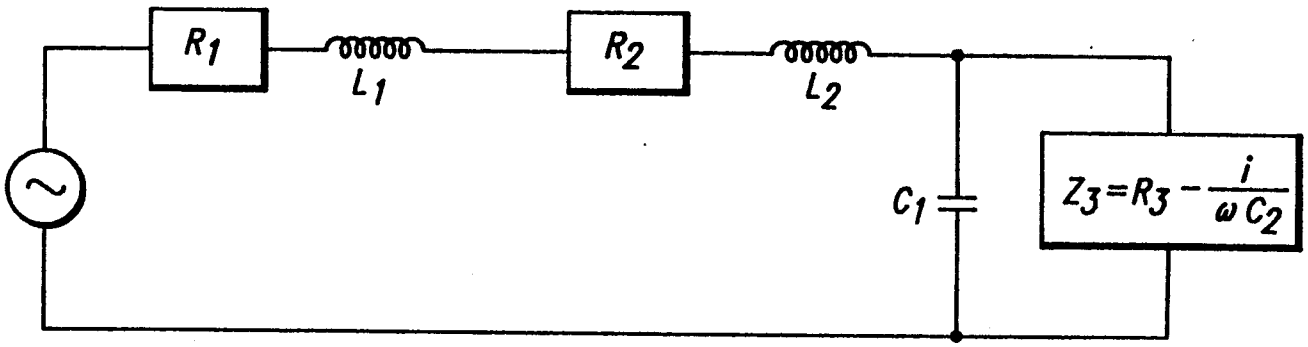
FIG. 1*b* is a schematic representation of an electrical equivalent connection for the acoustic channel in FIG. 1*a*.

The acoustic channel will be discussed in more detail in connection with the equivalence diagram in FIG. 1*b*.

Figure 2:
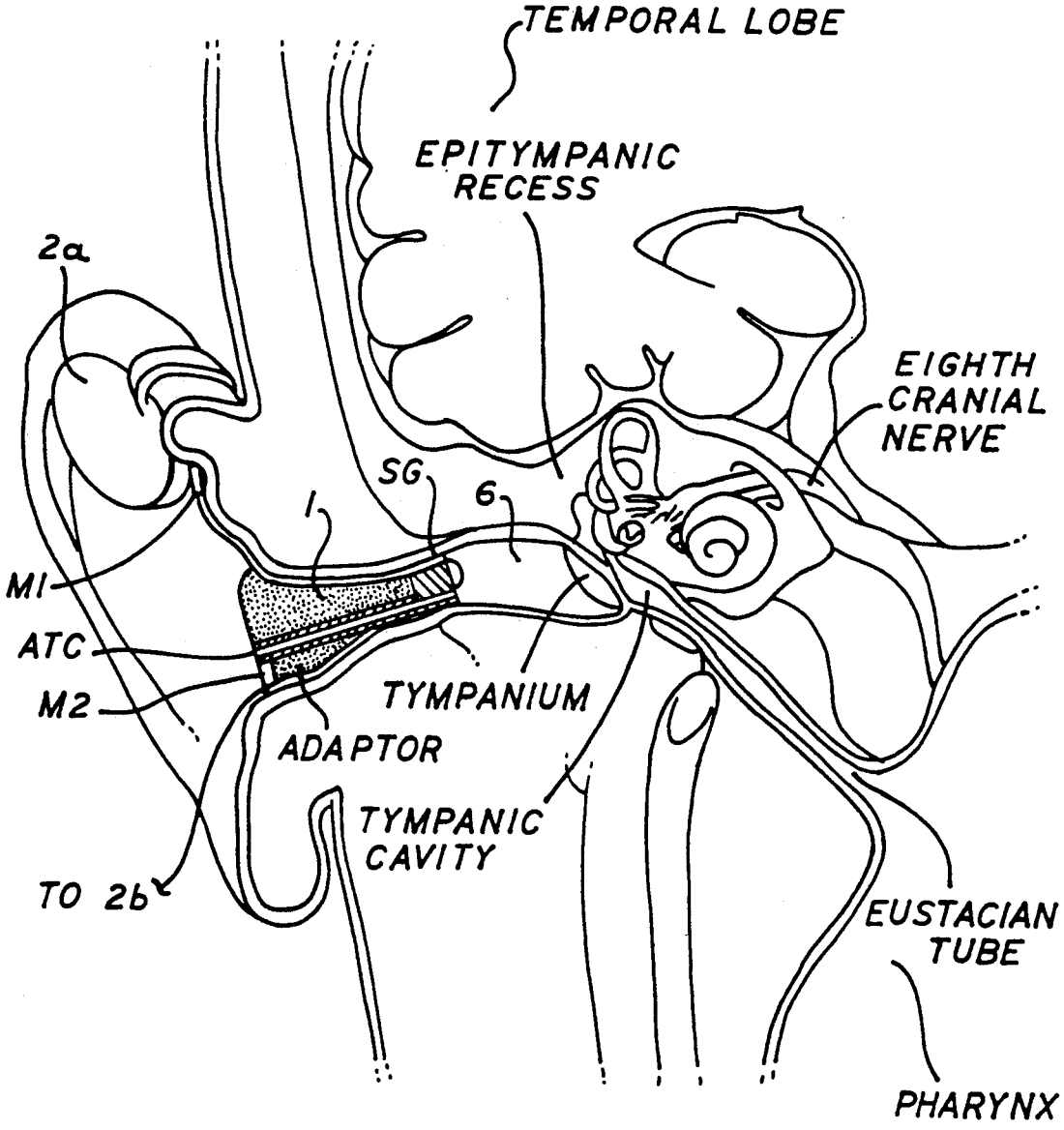
FIG. 2 is a variant of the hearing aid in accordance with the invention.

FIG. 2 shows a variant of the hearing aid in accordance with the invention. This variant comprises a main section with an acoustic transmission channel ATC which connects the ear opening with an inner portion of the meatus 6 and two microphones M1, M2, wherein the first microphone M1 is provided at a suitable place in the concha and the other microphone M2 at the outlet of the acoustic transmission channel ATC in the ear opening and at a distance from the first microphone M1. The electronic components which form part of the hearing aid are provided in a first secondary section 2*a* which here is positioned in the concha itself and connected with the main section 1, but they can also just as well be provided behind the concha. In this secondary section 2*a* it may be appropriate to provide a battery 4 for the hearing aid. Another not shown secondary section constitutes a case for the hearing aid.

On an inner end of the main section 1 is provided a miniaturised sound generator SG which faces the tympanum and converts the amplified electrical signal in the hearing aid to an acoustic signal which is intercepted by the tympanum. In order to have room inside a person's meatus while simultaneously also allowing an open acoustic connection, the sound generator SG must preferably have a diameter which is less than approximately 4.5 mm. In the hearing aid in accordance with the present invention an electrodynamic sound generator of the type described in the PCT application published as WO 91/01075 is utilized. This is an electrodynamic sound generator with a diameter of approximately 4 mm, allowing it to be placed in the meatus with good clearance from the wall of the meatus, since the meatus of an adult is normally approximately 7 mm in diameter. The sound generator in accordance with the said Norwegian patent application is constructed in such a way that it can be tuned in order to reproduce the meatus's natural resonance of approximately 3 kHz. At the same time in the main section 1 it becomes possible to provide an open connection in the form of an acoustic transmission channel ATC with an equivalent diameter of up to 2 mm. The equivalent diameter will depend on the selected critical frequency for the acoustic transmission channel ATC, and the higher the critical frequency selected, the larger the equivalent diameter must be. With a critical frequency of 1000 Hz, the diameter will be 4.8 mm, which, however, is unrealistic, but also completely unnecessary. The normal equivalent diameters will be of approximately 1 mm or even less.

Figure 3:
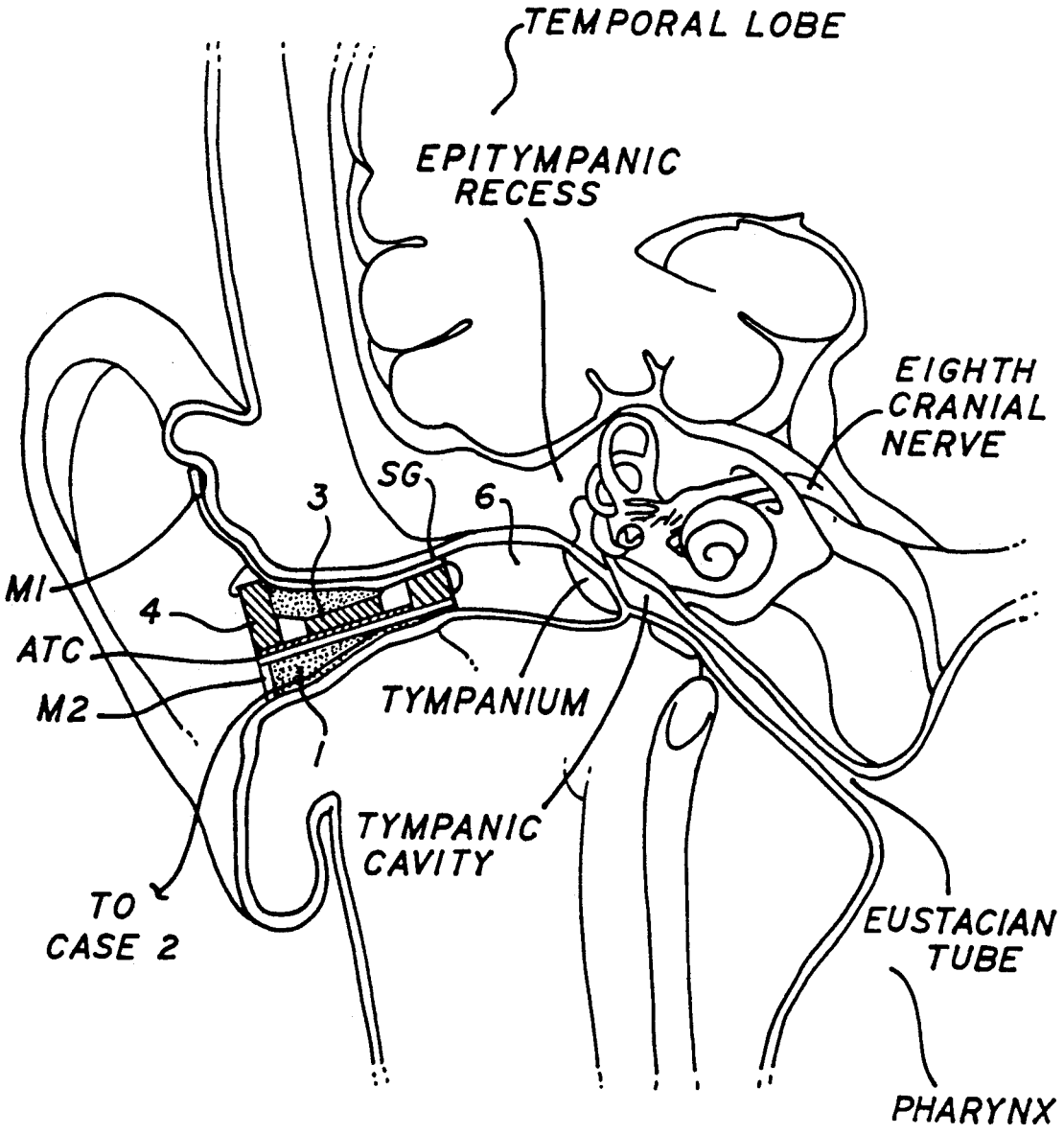
FIG. 3 is a further variant of the hearing aid in accordance with the invention.

In FIG. 3 the hearing aid in accordance with the invention is shown in a variant with two microphones M1 and M2 and a main section 1 inserted in the outer meatus 6 and constructed in a similar way to the main section 1 in FIG. 2. All the electronics as well as the hearing aid's battery 4 are provided in the main section 1, so that a secondary section provided in or beside the concha has been dispensed with. The hearing aid's main section 1 has rather been connected with a not shown secondary section 2 in the form of a case in which the main section is kept when the hearing aid is not in use and which may also comprise possible electronic and electrical auxiliary devices, including an external memory in the form of a random-access memory RAM1 which is supplied from a buffer battery. In addition, the not shown secondary section 2 also includes a rectifier and possibly plugs and switches and is arranged so that it is used for charging the hearing aid's battery 4 when the main section 1 is in the case. The main section 1 can then, e.g., be plugged directly into a wall socket via an adapter for charging.

Figure 4A:
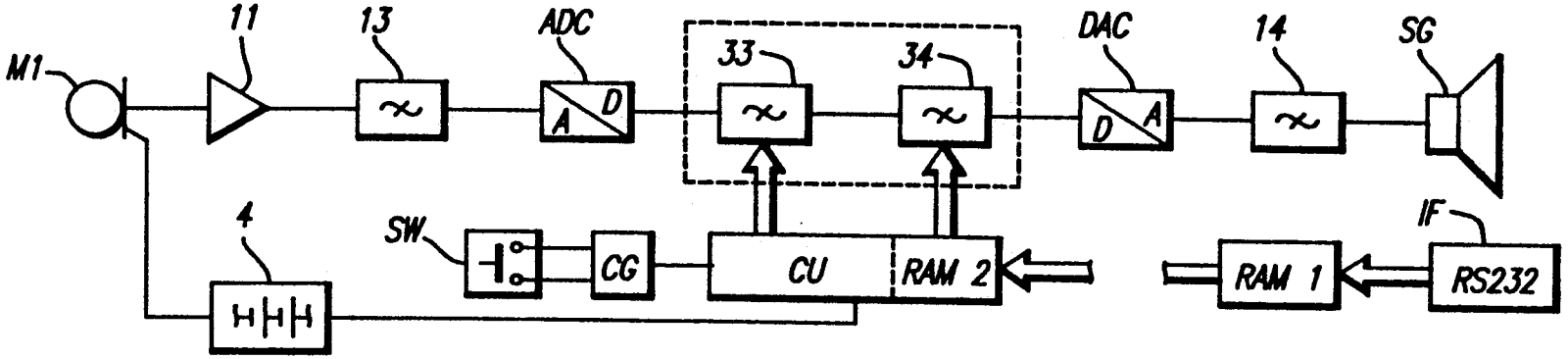
FIG. 4*a* is a schematic block diagram for a hearing aid in accordance with the invention, where one microphone is used.

The electrical and electronic components used for signal processing in a variant of the hearing aid in accordance with the invention with one microphone M1, will now be described in more detail with reference to FIG. 4*a*. All of these components can be provided in a suitable manner in the hearing aid's main section 1 or possibly in a first secondary section 2*a*. The microphone M1 is connected to a microphone amplifier 11 whose output is transmitted to a deconvolution filter 13 with a critical frequency of, e.g., 8 kH. This will therefore be the upper limit of the hearing aid's frequency response. The microphone M1 may be, e.g., a cardiod microphone which gives reduced feedback or a pressure or velocity microphone. Pressure microphones have the greatest sensitivity. It is advantageous, however, to use an electret microphone which can be made very small, and an impedance converter (not shown) will thus be fitted on the microphone output in front of the microphone amplifier 11. The signal from the deconvolution filter 13 is converted in an analog/digital converter ADC and transmitted to a digital signal processor DSP which comprises a compressor 33 connected in front of an equalizer 34. Inputs of the compressor 33 and the equalizer 34 are connected with outputs of a control unit CU which is connected with a first random-access memory RAM1. The control unit CU comprises a second random-access memory RAM2 and is also connected to a selector or a control device in the form of a switch SW, preferably a touch or pressure-sensitive switch. The compressor 33 and the equalizer 34 together constitute a digital signal processor DSP. The output on this is transmitted from the equalizer to the input of a digital-/analog converter DAC whose output is then connected to a reconstruction filter 14 connected in front of the inputs of a sound generator SG. In order to eliminate any acoustic feedback a cancellation filter 35 is used which in FIG. 4*b* is shown inserted in a feedback loop between the output of the equalizer 34 and the input of the compressor 33. The cancellation filter 35 is also connected to a further output of the control unit CU. The cancellation filter 35, however, can also, as shown in FIG. 4*c*, be installed in the signal's forward path in the digital processor, e.g. inserted between the output of the compressor 33 and the input of the equalizer 34. Both the compressor 33, the equalizer 34 and the cancellation filter also comprise random-access memories RAM3-5.

Figure 4D:
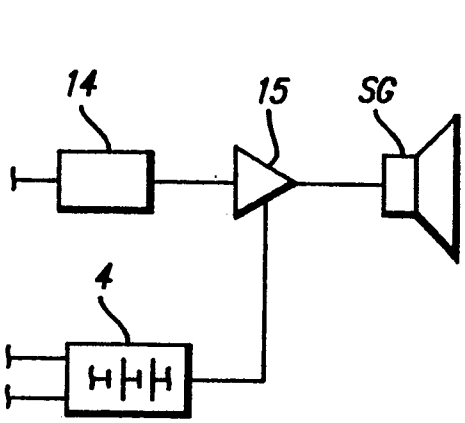
FIG. 4*d* shows the hearing aid in FIG. 4*a* with a power amplifier in the output stage.
Figure 4C:
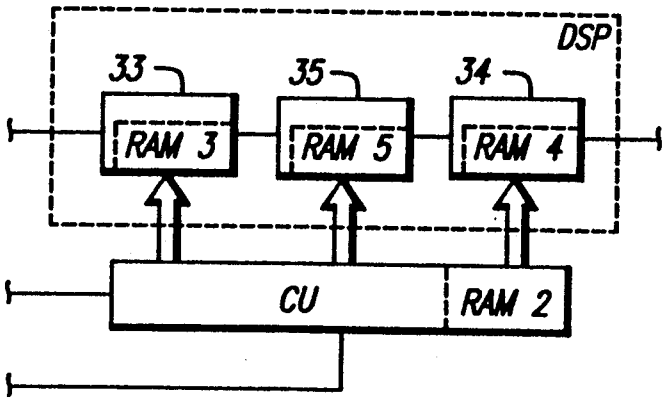
FIG. 4*c* shows the hearing aid in FIG. 4*a* with a cancellation filter inserted in the signal's forward path.
Figure 4B:
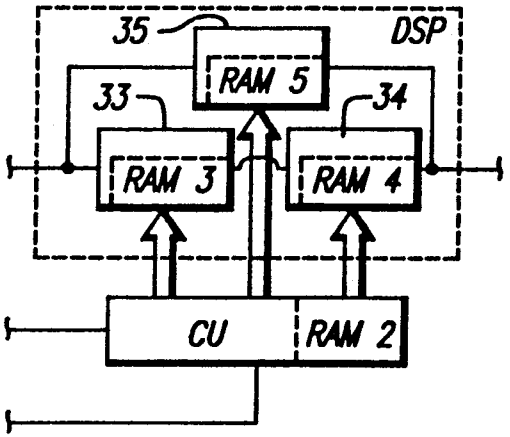
FIG. 4*b* shows the hearing aid in FIG. 4*a* with a cancellation filter inserted in a feedback loop.

Between the reconstruction filter 14 and the sound generator SG can be provided, as illustrated in FIG. 4*d*, a power amplifier to drive the sound generator. The microphone M1, the control unit CU and possibly the power amplifier 15 are all connected to a battery 4 which is preferably provided in the hearing aid's main section 1.

Figure 5A:
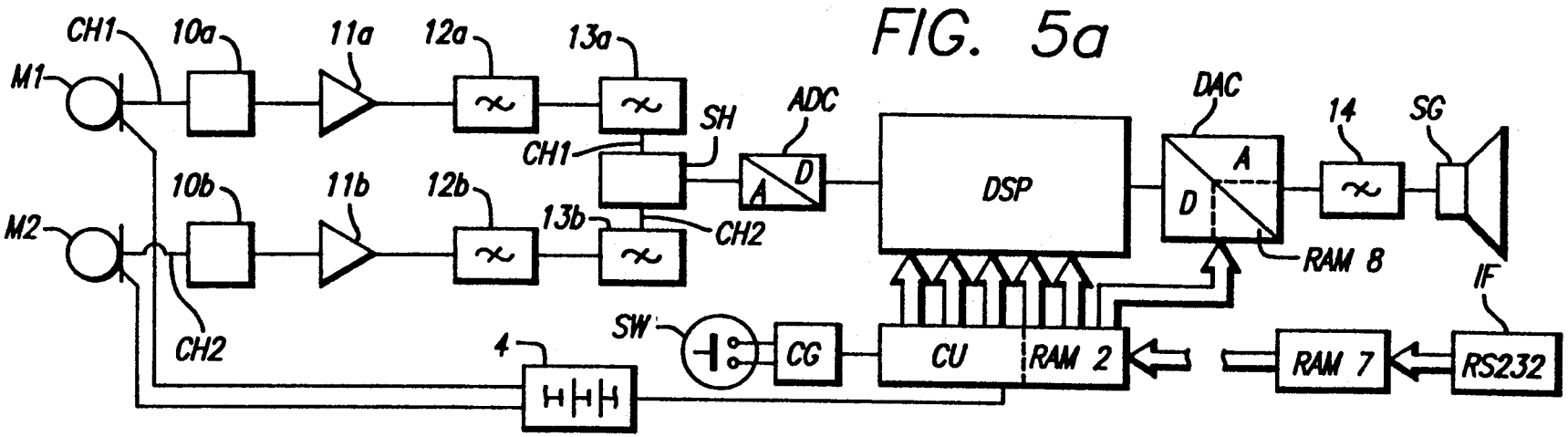
FIG. 5*a* shows a hearing aid in accordance with the invention, where two microphones are used.

FIG. 5*a* shows the electronic components for signal processing in a hearing aid in accordance with the invention which uses two microphones M1, M2. In the figure the microphones M1, M2 used are shown as electret microphones, in that the microphone output is connected to the impedance converters 10*a*, 10*b*. Each of the microphones M1, M2 forms the input to the first channel CH1 and a second channel CH2 respectively in the hearing aid's analog section. Each channel CH1, CH2 thus comprises a series connection of an impedance converter 10*a*, 10*b*, a microphone amplifier 11*a*, 11*b*, a compressor 12*a*, 12*b* and a deconvolution filter 13*a*, 13*b*. Each channel CH1, CH2 is carried to a first and a second input respectively of a sample-and-hold circuit SH. The sample-and-hold circuit SH which comprises a not shown monostable multivibrator MMV, is connected to an analog/digital converter ADC which is then connected to a digital signal processor DSP. A pulse-code modulated output signal from the analog/digital converter ADC is conveyed in the digital signal processor DSP shown in detail in FIG. 5b to a first signal path SP1 and a second signal path SP2 respectively. The first signal path comprises a series connection of an envelope generator 21 and a second compressor 22, while the second signal path SP2 comprises a series connection of a divider circuit 31, a rounding circuit 32, a third compressor 33, an equalizer 34 and a stabilizer/cancellation circuit 36 together with a pre-compensator 37. A second output on the envelope generator 21 is connected to a second input on the divider circuit 31.

Each of the second inputs on the compressor 22, the compressor 33, the equalizer 34, the stabilizer/cancellation circuit 36 and the precompensator 37 are connected to the respective outputs of a control unit CU. A first input of the control unit CU is connected to an external random-access memory RAM1 which is provided in the secondary section 2 and a second input of the control unit CU is connected to a cycle generator CG which is controlled from an external control device SW, preferably in the form of a touch-sensitive switch and, e.g., provided on the outside of the main section 1 in the ear opening. The power supply for the hearing aid passes through an input on the control unit connected to the battery 4 which is preferably provided in the main section 1. The battery 4 also supplies the microphones M1, M2. The compressor 22, the compressor 33, the stabilizer 34, the stabilizer/cancellation circuit 36 and the precompensator 37 each have provided random-access memories RAM3–RAM7. Similarly, the control unit CU comprises a random-access memory RAM2. The first signal path SP1 is carried from the output of the compressor 22 to the first input of a digital/analog converter DAC, while the second input of the digital/analog converter DAC is connected to the output of the precompensator 37. The digital/analog converter DAC comprises a further random-access memory RAM8. The output of the digital/analog converter DAC is carried to a reconstruction filter 14 whose outputs are connected to the input terminals of the sound generator SG.

A method for detection and signal processing will not be described in connection with the variant of the hearing aid which is illustrated in FIGS. 4a–c. An external sound field is detected by the microphone M1 and amplified in the microphone amplifier 11. The output signal from the microphone amplifier 11 is transmitted to the deconvolution filter 13 which has an upper critical frequency of 8 kH. The filtered signal is then transmitted from the deconvolution filter 13 to the input of the analog/digital converter ADC where it is sampled and converted preferably to a linear pulse-code modulated signal with 12 bits. The pulse-code modulated signal receives a dynamic limitation in the compressor 33, to, e.g., a level of 60 dB. The dynamically limited signal is conveyed to an equalizer 34 in the form of a digital filter network whose primary function is tone control but which in reality enables a number of functions to be performed. Firstly, the equalizer 34 can constitute a divider filter or crossover to the acoustic transmission channel ATC, perform correction for the effective amplitude response of the sound generator SG, correct any phase distortion in the crossover frequency range, perform an adaptation to the user's hearing residue and possibly also a frequency-dependent compression. A digital version of the crossover function can be implemented in several ways, the simplest being a complementary filter. The tone control in the equalizer 34 can be implemented in several ways, but the simplest and most preferred is the use of a parametric control by means of IIR filters. A hearing residue in the low frequency range, e.g. below 200 Hz, is safeguarded via the open acoustic transmission path from the ear opening to the inner meatus.

This acoustic transmission channel ATC functions as a low-pass filter whose characteristics in reality depend on the volume of the channel and the volume of the portion of the inner meatus 6 between the main section 1 and the tympanum. At the same time the acoustic transmission channel ATC acts together with the innermost portion of the meatus 6 as an acoustic resonator, giving a resonant acoustic amplification on the frequencies in the transmission channel's pass band. The output signal from the equalizer 34 is conveyed to the digital/analog converter DAC and is converted to an analog output signal $s_r$ which is smoothed in the reconstruction filter 14. The output signal from the reconstruction filter 14 is conveyed to the input terminals of the sound generator SG whose acoustic output signal mainly reproduces the detected external sound field by means of the microphone M1. However, this acoustic output signal $s_r$ will be fed back via the acoustic transmission channel ATC and will be added to the detected external sound field. In the case of high amplifications, e.g. over 55 dB, it will therefore be necessary to cancel this feedback signal, which is done preferably by means of a cancellation filter 35 in the digital signal processor DSP. The cancellation is performed in a purely digital manner in the cancellation filter 35 which can be provided in various ways in the digital signal processor, e.g. in a feedback loop between the output from the equalizer 34 and the input of the compressor 33 as illustrated in FIG. 4b, or in the signal's forward path, e.g. between the output on the compressor 33 and the input of the equalizer 34 as illustrated in FIG. 4c.

Figure 5B:
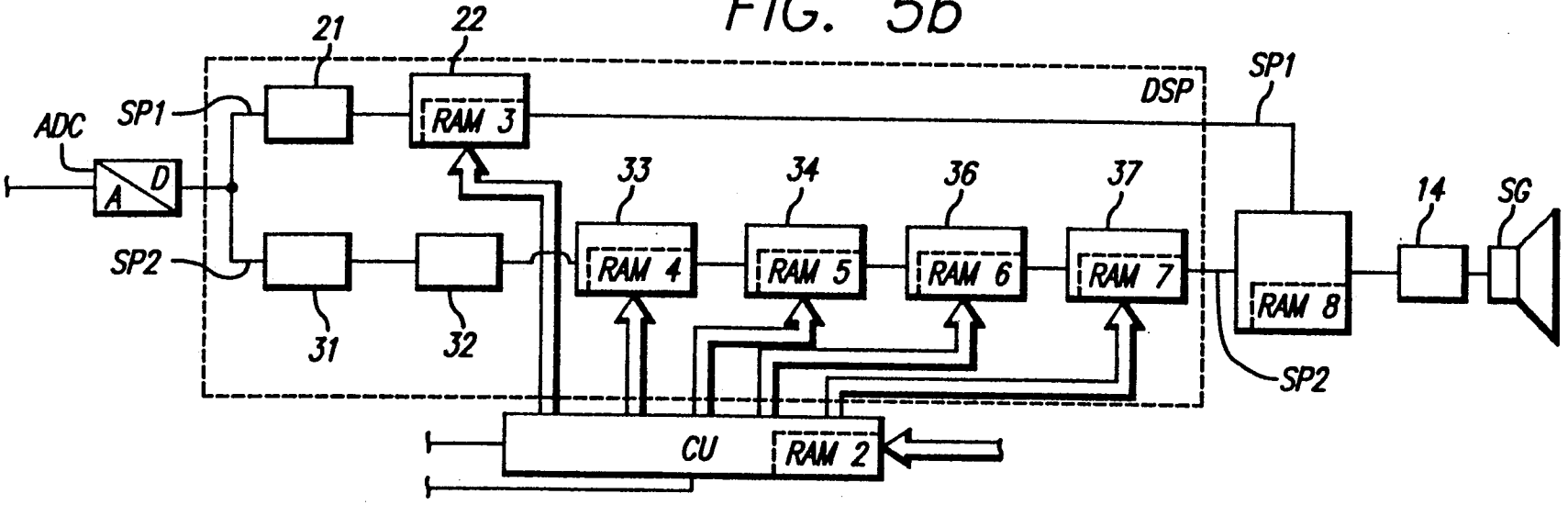
FIG. 5*b* shows a digital signal processor used with the hearing aid in FIG. 5*a*.

A method for detection and signal processing in accordance with the invention involving the use of a hearing aid with two microphones will now be described in more detail with reference to FIGS. 5a and 5b. The first microphone M1, which is preferably an electret microphone, is provided at an appropriate place in the concha, while the second microphone M2, which is also an electret microphone, is placed near the outlet of the acoustic transmission channel ATC in the ear opening. Both microphones M1, M2 will detect an external sound field at a level which is dependent on the sensitivity of the microphones and will in addition also detect any acoustic signal fed back through the acoustic transmission channel ATC. Since the microphone M1 is installed at a distance from the outlet of the acoustic transmission channel, the feedback acoustic signal will be somewhat attenuated at microphone M1 compared to the level at microphone M2. Microphone M2 is therefore given a correspondingly lower level of sensitivity than microphone M1, enabling the feedback acoustic signal to be detected at approximately the same level in the two microphones. The output signal $s_1$ from microphone M1 is transmitted to the first channel CH1 via the impedance converter 10a and amplified in the microphone amplifier 11a and then transmitted to the first compressor 12a which reduces the signal's dynamics to approximately 60 dB, in case the amplified microphone signal has a higher level than this. The deconvolution filter 13*a* gives the signal $s_1$ an upper critical frequency of 8 kHz, thereby acting as a band stop, after which the signal $s_1$ is transmitted to a first input of the sample-and-hold circuit SH. Similarly the microphone signal $s_2$ is transmitted from microphone M2 through corresponding components in the second channel CH2, viz. the impedance converter 10*b*, the microphone amplifier 11*b*, the compressor 12*b* and the deconvolution filter 13*b* to a second input of the sample-and-hold circuit SH with equal band limitation.

Figure 6A:
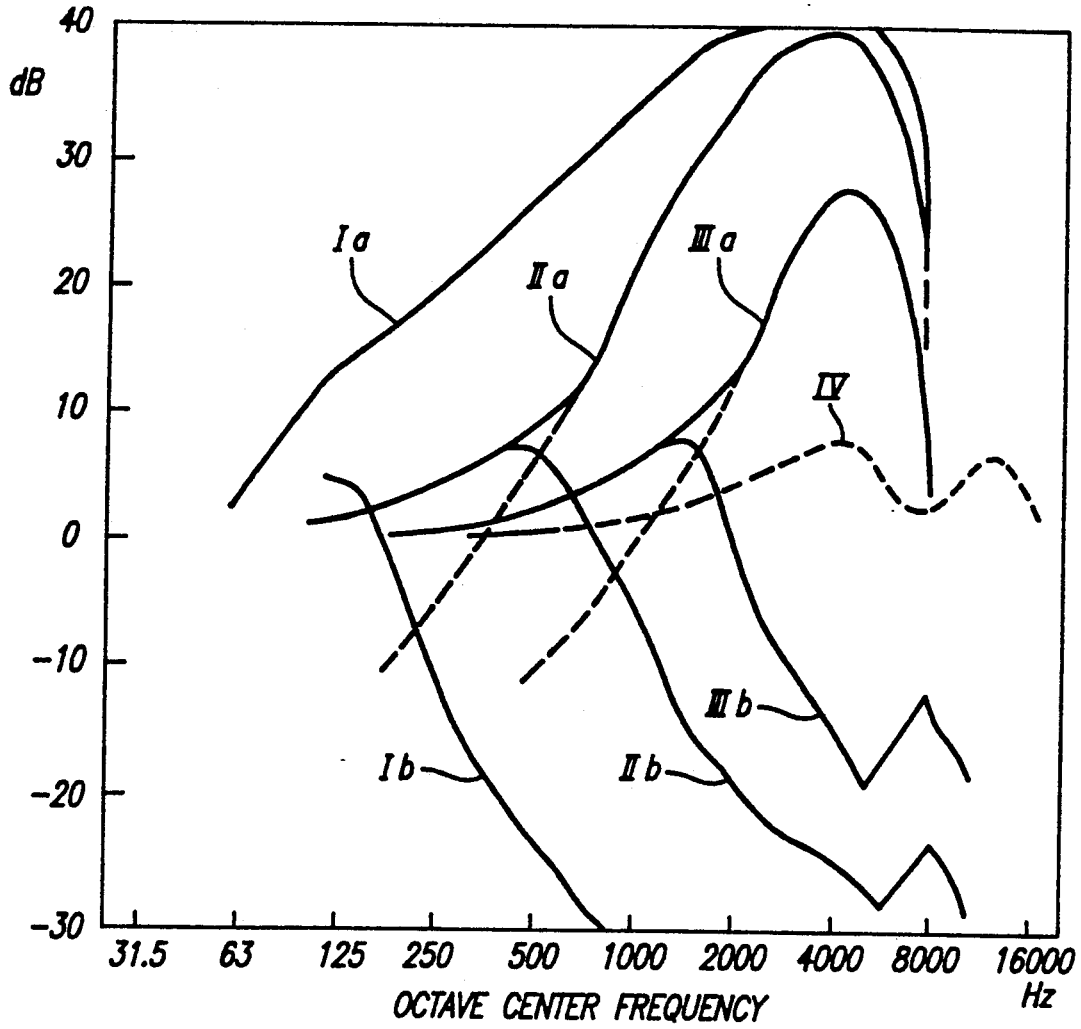
FIG. 6*a* is three examples of response curves for strong, moderate and weak hearing impairment respectively, in addition to the sound pressure response of a meatus without hearing aid.
Figure 6B:
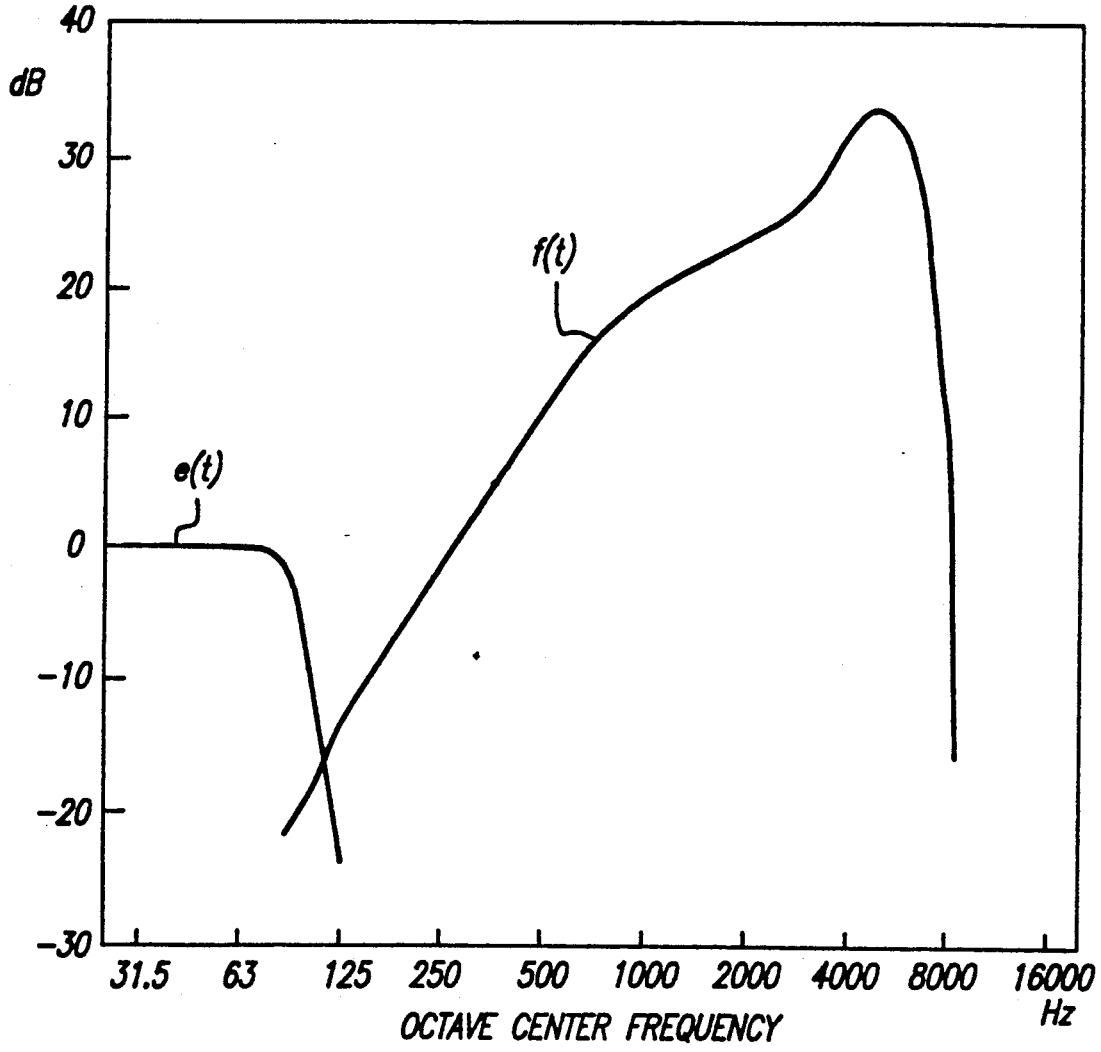
FIG. 6*b* is an example of the response curve for an envelope signal and a quotient signal generated in the digital signal processor in FIG. 5*b*.

By means of a not shown monostable multivibrator MVM the signal $s_2$ is now delayed for a period $\Delta t$ which corresponds to the propagation time difference for the sound waves between microphones M2 and M1, resulting in a phasing out of the feedback acoustic signal. The feedback compensated signal is sampled preferably at a frequency of 16 kHz, and it is thus seen that the delayed sampling in reality creates an all-pass filter which removes the feedback acoustic signal. The sampled signal $s_0$ is transmitted to the analog/digital converter ADC which converts the signal preferably to a linear pulse-code modulated spectral signal s(t) with, e.g. 12 bits. This pulse-code modulated signal s(t) is transmitted to the envelope generator 21 which generates the envelope in the form of a signal e(t) whose bandwidth is limited to 30 Hz, and which preferably has a length of 4 or 6 bits. The pulse-code modulated output signal s(t) from the analog/digital converter ADC is also transmitted to an input of the divider circuit 31 which via a second input receives the envelope signal e(t) from the envelope generator 21. In the divider circuit 31 the division $s(t)/e(t)=f(t)$ is performed, in that s(t) represents the output signal from the analog/digital converter ADC. After the division the quotient signal f(t) is rounded off in a rounding circuit 32, preferably giving a result of 8 bits and possibly 6 bits. The envelope signal e(t) thus represents the amplitude components of the spectral signal s(t), while the quotient signal f(t) represents the frequency components of the spectral signal s(t). The frequency response for e(t) and f(t) respectively are also shown in FIG. 6*b*.

The digital signal processor DSP now transmits the envelope signal e(t) from the envelope generator 21 to the compressor 22, where it is further compressed, e.g. to 30 dB, in that e(t) as has already been mentioned has been compressed in advance to 60 dB. The compressed envelope signal e(t) is then transmitted further along signal path SP1 to a first input of the digital/analog converter DAC.

The quotient signal f(t) is passed on from the rounding circuit 32 to the compressor 33 where its frequency response is modified and where a further compression of the signal is performed. The compressed and response-modified quotient signal is then transmitted to the equalizer 34. The equalizer 34 acts as a digital tone control stage, providing an optimum frequency response curve to the signal f(t). In the form of a digital filter the equalizer 34 can also simultaneously enable correction of both phase and amplitude to be performed for the signal f(t).

The lower critical frequency of the signal f(t) becomes the crossover frequency to the acoustic transmission channel ATC and will therefore be determined by the latter's upper critical frequency. The crossover function can moreover be implemented to advantage either in the compressor 33 or in the equalizer 34.

The choice of filter coefficients in the compressor 33 and the equalizer 34 result in fluctuations in the quotient signal f(t), but these can with advantage be removed in the stabilizer/cancellation circuit 36 which is installed after the equalizer 34. Normally, it will be possible to amplify the spectral signal s(t) by 35 dB without the use of cancellation of a possible feedback acoustic signal. When using a two-microphone technique in accordance with the invention, a further 20 dB is gained, giving a total amplification of 55 dB. A higher amplification, however, requires any frequency components of the feedback acoustic signal to be cancelled. Now the total amplification is determined by the selected response function for the hearing aid and cancellation is therefore only required if the response function gives an amplification of over 55 dB. In such cases, therefore, any residue of the acoustic feedback signal in f(t) is cancelled in connection with the stabilization of the optimum frequency response curve in the stabilizer/cancellation circuit 37. Cancellation may be performed in various ways which are well-known to specialists in the field, but as already mentioned adaptive feedback cancellation has been found to be particularly expedient and enables a further amplification of approximately 10 dB without acoustic feedback causing any negative effects.

After stabilization and possible cancellation the quotient signal f(t) is transmitted to the precompensator 37 for compensation of any non-linearities in the quotient signal f(t). The precompensation particularly comprises compensation of distortion generated in the analog/digital converter ADC together with precompensation of distortion generated by the digital/analog converter DAC or the sound generator SG. It should be noted in this connection that problems of linearity in analog/digital conversion and vice versa are well known in the technique, and a compensation for non-linearity will thus be necessary if high-linear converters are not used. Since the degree of non-linearity generated by the converters ADC and DAC together with the sound generator SG as a rule can be predetermined, the compensation for non-linearity can be performed by taking the compensation values from a stored table in the precompensator 37. The compensated quotient signal is then transmitted to a second input of the digital/analog converter DAC. In the digital/analog converter DAC the output level of the spectral signal s(t) is tuned, in that the tuning is performed in accordance with the amplification selected for the required response function. The tuning can be performed digitally as an arithmetical operation on the envelope signal e(t), e.g. by determining the amplification by reference to a stored table. The envelope signal e(t) is then converted to a pulse-width modulated signal with sampling frequency, in that the envelope signal e(t) modulates the sampling signal. Similarly, the compensated quotient signal f(t) is then converted to a pulse-height-modulated signal with sampling frequency, in that f(t) modulates the sampling signal.

A tuning of the output level of the spectral signal s(t) can also be performed by multiplying the pulse-width modulated envelope signal e(t) by a selected factor k. The required amplification for a given response function is thus determined by the value of k. In connection with the tuning of the spectral signal's output level, it will also be possible to compensate for any reduction in the hearing aid's battery voltage. In this case this is done via the control unit CU and the compensation will usually be 1 bit for a voltage drop of over 10% if it occurs in connection with the digital signal e(t) or by a corresponding correction of factor k if compensation for the drop in voltage is performed in connection with the pulse-width modulated signal e(t). However, the compensation value must be adapted to the absolute value of e(t).

The processed spectral signal s(t), which corresponds to a given response function, is now generated by multiplying the pulse-width modulated signal e(t) by the pulse-height modulated signal f(t). The product $s(t)=e(t)\cdot f(t)$ is then converted to the analog output signal $s_r$ which is smoothed in a reconstruction filter 14 and transmitted to the sound generator SG for conversion to an acoustic output signal which mainly reproduces the external sound field detected by the microphones M1, M2 minus any detected feedback acoustic signal. In the case of the digital/analog converter DAC it will be seen that the use of a pulse-width modulated signal which can be limited to a constant low level, will only result in switching losses in the transistors. By designing the converter DAC as a high-output converter the hearing aid may be constructed without the use of a power amplifier for the sound generator SG. If it had been necessary to use a power amplifier, this could have been implemented as a pulse-width-modulated amplifier of class D, controlled directly by the digital signal. In the version preferred here, however, as already mentioned the digital/analog converter DAC drives the sound generator SG directly and also has the ability to considerably reduce collector loss in the output transistors in that the pulse-height modulated signal f(t) comes after the pulse-width modulated signal e(t).

The provision of the acoustic transmission channel ATC in the main section of the hearing aid is illustrated in FIGS. 2 and 3. In the preferred version channel ATC constitutes a first order low-pass filter whose critical frequency is given by the channel's acoustic impedance and equivalent diameter for a constant length of the channel. It will be obvious, moreover, that the channel may also consist of several smaller, through-going holes. If, e.g., the length of the channel is 1 cm, the equivalent diameter for a critical frequency of 1000 Hz will be 2 mm, as already mentioned. For practical reasons the acoustic transmission channel ATC is constructed as a first order low-pass filter, since a version in the form of a higher order filter is difficult to implement due to the dimensions of the hearing aid. The approximate electrical equivalent diagram for the acoustic transmission channel ATC is illustrated in FIG. 1*b*. It can be seen that the acoustic transmission channel together with the volume of the said portion of the inner meatus 6 and the tympanum impedance can be represented by an RLC network, with a condenser in parallel. The tympanum impedance has an important effect on all transmission paths, viz. acoustic through the transmission channel and electroacoustic in the case of feedback over the sound generator. The acoustic transmission channel ATC also acts together with the said portion of the meatus 6 as a resonant amplifier, in that the volume of the said portion constitutes the resonant cavity. For an equivalent diameter of the channel of 2 mm and a length of 10 mm, the maximum amplification will normally be in the order of approximately 38 dB. An increase in the equivalent diameter and thus also in the acoustic filter's critical frequency reduces the amplification. If the frequency range of the hearing residue in the bass range is small, a correspondingly greater amplification in the electroacoustic channel will be required. This will result in greater power consumption and a larger battery will therefore be required. In that case, the reduction in the diameter of the acoustic channel will, however, make more room available for the battery 4 in the hearing aid's main section 1, while a hearing residue of a greater frequency range, though requiring a larger equivalent diameter, will also require a correspondingly smaller battery. In other words a channel is obtained with a small equivalent diameter in the case of severe hearing impairment which requires a correspondingly larger battery, while in the case of minor hearing impairment which requires a correspondingly smaller battery, a channel is obtained with a relatively larger equivalent diameter.

The compressor 22, the compressor 33, the equalizer 34, the stabilizer/cancellation circuit 36 and the precompensator 37 in the digital signal processor DSP are each supplied with memories in the form of random-access memories RAM3–7. The digital/analog converter DAC also contains a memory in the form of a random-access memory RAM8. Furthermore, it is also advantageous at least to construct the compressor 33, the equalizer 34 and the stabilizer/cancelling circuit 36 as an integrated filter network. The transfer functions of the individual filters can now be altered in that these are provided with different sets of filter coefficients, a set of filter coefficients being provided for each individual filter, viz. said components 22, 32, 33, 34 and 36, and the separate filter coefficients for each filter which is part of the coefficient set stored in the appropriate random-access memories RAM3–RAM6. Each individual set of filter coefficients thus represents a specific response function for the hearing aid together with the set of compensation values which is stored in the memory RAM7 connected with the precompensator 37 and the amplification parameters which are stored in the memory RAM8 connected to the digital/analog converter DAC. All the parameters, including the filter coefficients, which are required in order to generate a specific response function, are stored in the memory RAM2 in the control unit CU and also in the external random-access memory RAM8 which is provided in the hearing aid's secondary section 2 or in a case and constitutes a spare memory.

Normally the user will be offered a menu of several response functions with a corresponding number of stored parameter sets. The menu control is installed in the control unit CU and is called continuously and cyclically by means of a cycle generator CG coupled to the control unit and connected to a control device in the form of a pressure or touch keypad SW which with advantage may be installed in the ear opening on the outside of the hearing aid's main section 1. By a light touch on the control keypad the user will access a new set of parameters for a specific response function from the memory RAM2 in the hearing aid's control section and input it to the digital signal processor DSP. Successive touches of the control keypad SW access all the menu's response functions in succession, and thus, by means of a few touches, the user can quickly find the response function which best suits his acoustic environment and required amplification.

A typical menu of response functions can include, e.g., five such functions. Each of the response functions is adapted to the user's hearing and gives the best possible result for a specific, external, acoustic environment. The individual adjustment of the hearing aid for each user will therefore require a determination of parameters for the required response functions on the basis of audiometric examinations of the person and use of acoustic parameters which represent specific external, acoustic environments, together with a choice of equivalent diameter for the acoustic transmission channel ATC, its parameters being determined by the user's hearing residue.

The hearing aid can easily be reprogrammed to suit altered user conditions and changes in the hearing of the user or the hearing of another user. Reprogramming is performed in that the random access memory RAM1 in the case or secondary section 2 is connected via an interface IF of type RS232 to a computer, e.g. a personal computer which is connected to an audiometer system. Audiometric measuring procedures which can be used in connection with a computer to reprogram digital hearing aids are well known in the art, and in this connection reference is made to DE-OS no. 27 35 024, U.S. Pat. No. 3,808,354, PCT application no. WO85/00509 together with the paper "A general-purpose hearing aid prescription, simultation and testing system" (Jamieson et al.), IEEE Transactions on Acoustics, Speech and Signal Processing, 1989, no. 2, pp. 1989–92.

The optimization of the individual response functions is obtained by adapting the amplification to the sound level, thus reducing noise and by making optimum use of the weighted frequency response so that it gives the best possible signal/noise ratio at low levels. The optimum response curve is thus primarily obtained by a level-controlled frequency weighting. Examples of response curves which correspond to specific response functions are shown in FIG. 6*a*. Three different response functions are here represented by graphs designated by I, II and III respectively. The upper graph Ia, IIa, IIIa gives the response of the electroacoustic channel and the lower graph Ib, IIb, IIIb that of the corresponding acoustic transmission channel. The response function I is the optimal in the case of strong hearing impairment, while II is adapted to a moderate hearing impairment and III a weak hearing impairment. IV shows the curve for the sound pressure response of the meatus without the use of a hearing aid. It can be seen that the hearing residue, as represented in the lower graph in each case, has a small frequency range in the case of strong hearing impairment and a correspondingly low critical frequency for the acoustic low-pass filter.

By offering the user different response functions adapted to the external acoustic environment, the response function which gives approximately normal hearing volume and an optimum subjective hearing impression can be chosen. The individual response functions have different amplification, and by choosing a suitable response function the user will also be able to avoid the problem of "recruitment", the phenomenon which people with neurological hearing loss often experience near normal hearing volume when the signal level is above the hearing threshold. The sound generator will be operated with a power which corresponds to the amplification, and the generated sound pressure level will normally be approximately 120 dB in the case of strong hearing impairment and, e.g., 100 dB in the case of a more moderate hearing impairment.

Thus within the scope of the claims in accordance with the invention there has been provided a programmable hearing aid with digital signal processing, which is hybrid in the sense that it is based on a combination of digital and acoustic filtering in order to safeguard any low frequency hearing residue which the user may have. All the electronics in the hearing aid's electroacoustic channel, i.e. the analog input section, the digital signal processor DSP, the control section CP and the analog output section are implemented as a monolithic VLSI circuit in a CMOS chip.

A hearing aid of this type, which is equipped with only one microphone, will be capable of giving an amplification of 35 dB without cancellation, and with the use of cancellation in the digital signal processor a further 10 dB are gained, giving a total amplification of 45 dB. By using a hearing aid in accordance with the invention with two microphones and phasing out of an acoustic feedback signal 20 dB are gained, giving a total amplification of 55 dB. For amplification beyond this range a further cancellation of the feedback signal is necessary, and a further 10 dB can then be gained, giving in this case a total obtainable amplification of 65 dB, and consequently an improvement of 20 dB compared to the one-microphone technique. In the case of moderate amplifications, therefore, the feedback acoustic signal will be virtually completely suppressed by means of delayed sampling in the sample-and-hold circuit SH. Moreover, it will also be possible to suppress a feedback signal by altering the phase relationships between this and the direct signal in the digital signal processor, but this will necessitate an analog/digital converter for each channel CH1, CH2, and the use of delayed sampling is therefore to be preferred. By reducing the amplification the feedback signal will naturally always be suppressed, while at high amplifications, i.e. for the present invention over 55 dB, cancellation is also used in one of the filters in the digital signal processor, in this case the stabilizer/cancelling circuit 36. Thus only those response functions which have an amplification over 55 dB will have coefficients entered for cancellation.

Cancellation of a feedback signal can be performed digitally by means of several methods known in the art. In principle cancellation is performed on condition that the signal through the filter is the same with and without feedback. In the case of broad-band cancellation it is theoretically possible to obtain 20 dB, while for the hearing aid in accordance with the invention a form of adaptive cancellation is preferred, since this allows consideration to be given to the frequency-dependent tympanum impedance. In this connection it may seem reasonable to expect an attainable gain of approximately 10 dB by using adaptive cancellation, i.e. the maximum, stable amplification for the hearing aid can be increased to 65 dB without loss of speech quality.

In light of the above, therefore, it can be seen that in accordance with the invention a hybrid hearing aid of the all-in-the-ear type is provided which permits a sound pressure level of over 120 dB at the tympanum with little distortion over a frequency range which extends from approximately 60 to 8,000 Hz, i.e. over 7 octaves, and with a ratio between the signal level and the quantifying noise level during the analog/digital conversion of over 70 dB, since effective use is made of 12 bits per sample during quantification. A suitable analog compression prior to the quantification ensures an effective linear dynamic range of over 90 dB. The result, therefore, is a hearing aid which can be adapted in an optimum manner to most forms of age-dependent and neurological hearing loss and which gives the user a completely adequate reproduction of external sound fields, which, e.g., represent speech and music, and wherein special emphasis is placed on maintaining the tonal qualities of the sound by ensuring an optimum reproduction of the frequency band for the formants in, e.g., speech.

We claim:

1. A programmable hybrid hearing aid with digital signal processing, comprises and a main section (1) and two a secondary section (2*b*), both are connected to the main section, wherein the main section (1), preferably in the form of an earplug, can be inserted substantially in the outer meatus (6) of a person and has provided a microphone (M1) and a sound generator (SG), wherein the first secondary section (2*a*) is provided in or behind the concha and provided so as to receive electrical and electronic components, wherein the second secondary section (2*b*) is a case arranged so as to contain the main section (1) and the first secondary section (2*a*) when the hearing aid is not in use, together with possible electronic and electrical auxiliary devices as well as an external memory in the form of a random access memory (RAM1), a buffer battery, an equalizer and any plugs and switches, and wherein the hearing aid includes an open portion of the outer meatus (6) preferably provided in the main section (1), characterized in that the open connection constitutes an acoustic transmission channel (ATC) with low-pass characteristic and resonant amplification, that the hearing aid also comprises an analog input section with a microphone amplifier (11) and a deconvolution filter (13), a digital signal processor (DSP) with a compressor (33) and an equalizer (34), each of which contains random-access memories (RAM3, RAM4) together with an analog output section with a reconstruction filter (14), that the microphone (M1) is connected to the input of the microphone amplifier (11), that the analog input section is connected to the digital signal processor (DSP) via an analog/digital converter (ADC), that the digital signal processor (DSP) is connected to the analog output section via a digital/analog converter (DAC), that the outputs of the reconstruction filter (14) are connected to the terminals of the sound generator (SG), that each of the second inputs of the compressor (33) and the equalizer (34) respectively are connected to the respective outputs of a control unit (CU) which contains a random-access memory (RAM2), that the first input on the control unit (CU) is connected to the external random-access memory (RAM1) and a second input with an external control device (SW) for menu-controlled selection from a number of response functions for the hearing aid pre-stored in the control unit's memory (RAM2), and that the same response functions also are stored in the external memory (RAM1) which constitutes a backup memory for the control unit's memory (RAM2), and which is also connected to an interface (IF) of type RS232.

2. A hearing aid in accordance with claim 1, characterized in that at the outlet of the acoustic transmission channel (ATC) in the ear opening is provided a further microphone (M2), that both microphones (M1,M2) are separated from each other by a specific distance and have different degrees of sensitivity, that each of the microphones (M1,M2) is connected to a first and second channel (CH1,CH2) respectively in the analog input section, and that each channel contains a microphone amplifier (11) and a deconvolution filter (13) and each is connected to its own input of a sample-and-hold circuit (SH) which is connected to the digital signal processor (DSP) via the analog/digital converter (ADC).

3. A hearing aid in accordance with claim 2, characterized in that the first secondary section (2*a*) comprises one or more of the following components: the analog input section, the digital signal processor (DSP), the control unit (CU), the analog output section and preferably also the battery (4).

4. A hearing aid in accordance with claim 1, characterized in that the analog input section, the digital signal processor (DSP), the control unit (CU) and the analog output section being implemented as a monolithic integrated circuit (3).

5. A programmable hybrid hearing aid with digital signal processing, which comprises a main section (1) and a secondary section (2) connected to the main section, wherein the main section (1), preferably in the form of an earplug, can be inserted substantially in the outer meatus (6) of a person and is fitted with a microphone (M1), a sound generator (SG) and preferably also a battery (4), wherein the secondary section (2) is a case provided so as to contain the main section (1) when the hearing aid is not in use, together with any electronic and electrical auxiliary devices such as an external memory in the form of a random-access memory (RAM1), a buffer battery, an equalizer and any plugs and switches, and wherein the hearing aid includes an open connection between the ear opening and an inner portion of the outer meatus (6) preferably provided in the main section (1), characterized in that the open connection constitutes an acoustic transmission channel (ATC) with low-pass characteristic and resonant amplification, that the main section (1) also comprises an analog input section with a microphone amplifier (11) and a deconvolution filter (13), a digital signal processor (DSP) with a compressor (33) and an equalizer (34), each of which contains random access memories (RAM3, RAM4), together with an analog output section with a reconstruction filter (14), that the microphone (M1) is connected to the input of the microphone amplifier (11), that the analog input section is connected to the digital signal processor (DSP) via an analog/digital converter (ADC), that the digital signal processor (DSP) is connected to the analog output section via a digital/analog converter (DAC), that the outputs of the reconstruction filter are connected to the clamps of the sound generator (SG), that each of the second inputs on the compressor (33) and the equalizer (34) respectively are connected with the respective outputs on a control unit (CU) which contains a random-access memory (RAM2), and that the first input on the control unit (CU) is connected to the external random-access memory (RAM1), and a second input to an external control device (SW) for menu-controlled selection from a number of response functions for the hearing aid pre-stored in the control unit's memory (RAM2), the same response functions also being stored in the external memory (RAM1) which constitutes a backup memory for the control unit's memory (RAM2) and also is connected to an interface (IF), preferably of type RS232.

6. A hearing aid in accordance with claim 5, characterized in that the digital signal processor (DSP) contains a cancellation filter (35) inserted in the forward path of the output signal from the output signal from the analog/digital converter (ADC) or in a feedback loop between the output on the equalizer (34) and the first input on the compressor (33), that a second input on the cancellation filter (35) is connected to a further output of the control unit (CU), and that the cancellation filter (35) also contains a random-access memory (RAM5).

7. A hearing aid in accordance with claim 5, characterized in that the analog output section also contains a power amplifier (15) to drive the sound generator (SG), that the input of the power amplifier is connected to the output on the reconstruction filter (14) and its outputs to the terminals of the sound generator (SG).

8. A hearing aid in accordance with claim 5, characterized in that the sound generator (SG) is an electrodynamic sound generator.

9. A hearing aid in accordance with claim 5, characterized in that the analog input section, the digital signal processor (DSP), the control unit (CU) and the analog output section being implemented as a monolithic integrated circuit (3), preferably in CMOS technology.

10. A programmable hybrid hearing aid with digital signal processing, which comprises a main section (1) and a secondary section (2) connected to the main section, wherein the main section (1), preferably in the form of an earplug, can be inserted substantially in the outer meatus (6) of a person and is fitted with two microphones (M1,M2), a sound generator (SG) and preferably also a battery (4), wherein the secondary section (2) is a case provided so as to contain the main section (1) when the hearing aid is not in use, together with any electronic and electrical auxiliary devices such as an external memory in the form of a random-access memory (RAM1), a buffer battery, an equalizer and any plugs and switches, and wherein the hearing aid includes an open connection between the ear opening and an inner portion of the outer meatus (6) preferably provided in the main section (1), characterized in that the open connection constitutes an acoustic transmission channel (ATC) with low-pass characteristic and resonant amplification, that the first microphone (M1) which is electrically connected to the main section (1), is provided in a suitable place in the concha and at a distance from the acoustic transmission channel's (ATC) outlet in the ear opening, that a second microphone (M2) which is less sensitive than the first microphone (M1), the difference in sensitivity being adapted to the distance between the microphones (M1,M2), is provided at the acoustic transmission channel's (ATC) outlet in the ear opening, that the main section (1) comprises an analog input section with a first channel (CH1) connected to the output of the first microphone (M1), and a second channel (CH2) connected to the output of the second microphone (M2), that each channel (CH1, CH2) is connected to a first and second input respectively of a sample-and-hold circuit (SH), that each channel (CH1, CH2) contains a microphone amplifier (11*a*, 11*b*), a first compressor (12*a*, 12*b*) and a deconvolution filter (13*a*, 13*b*) connected in series, that the main section (1) comprises a digital signal processor (DSP) connected to the output of the analog input section via an analog/digital converter (ADC), that the digital signal processor (DSP) comprises a first signal path (SP1) consisting of a series connection of an envelope generator (21) and a second compressor (22), a second signal path (SP2) consisting of a series connection of a divider circuit (31) with a second input connected to a second output of the envelope generator (21), a rounding circuit (32), a third compressor (33), an equalizer (34), a stabilizer/cancellation circuit (36) and a precompensator circuit (37), that the second compressor (22), the third compressor (33), the equalizer (34), the stabilizer/-cancelling circuit (36) and the precompensation circuit (37) each contains a random-access memory (RAM-3-7), that each signal path (SP1,SP2) is carried to the first and second inputs respectively on a digital/analog converter (DAC), that second inputs on the second compressor (22), the third compressor (33), the equalizer (34) and the stabilizer/cancellation circuit (36) together with the precompensator circuit (37) respectively are connected to the respective outputs of a control unit (CU) whose first input is connected to the external random-access memory (RAM1) and second input to a cycle generator (CG) connected to an external control device (SW) for menu-controlled selection from a number of response functions for the hearing aid pre-stored in a random-access memory (RAM2) contained in a control unit (CU), that the same response functions are also stored in the external memory (RAM1) which constitutes a backup memory for the control unit's memory (RAM2) and also is connected to an interface (IF), preferably of type RS232, and that the main section (1) comprises an analog output section whose input is connected to the output of the digital-/analog converter (DAC), and that the analog output section contains a reconstruction filter (14) whose outputs are connected to the terminals of the sound generator (SG).

11. A hearing aid in accordance with claim 10, characterized in that the microphones (M1,M2) are electret microphones, each of which is connected at its output via impedance converters (10*a*, 10*b*) to the input of the microphone amplifier (11*a*, 11*b*) in the first (CH1) and second channel (CH2) respectively.

12. A hearing aid in accordance with claim 10, characterized in that the deconvolution filter (12*a*, 12*b*) has a critical frequency of 8 kHz.

13. A hearing aid in accordance with claim 10, characterized in that the sample-and hold circuit (SH) contains a monostable multivibrator.

14. A hearing aid in accordance with claim 10, characterized in that and that the third compressor (33), the equalizer (34) and the stabilizer/cancelling circuit (36) constitute an integrated filter network.

15. A hearing aid in accordance with claim 10, characterized in that the digital/analog converter (DAC) is a multiplying converter.

16. A hearing aid in accordance with claim 15, characterized in that and that the digital/analog converter (DAC) contains means for tuning the output signal level, said means comprising a random access memory (RAM8) connected to a sixth output of the control unit (CU).

17. A hearing aid in accordance with claim 10, characterized in that the sound generator (SG) is an electrodynamic sound generator.

18. A hearing aid in accordance with claim 10, characterized in that the acoustic transmission channel (ATC) constitutes a first order acoustic filter.

19. A hearing aid in accordance with claim 18, characterized in that the acoustic transmission channel (ATC) jointly with the inner portion of the outer meatus (6) constitutes a resonant acoustic amplifier.

20. A hearing aid in accordance with claim 19, characterized in that the acoustic transmission channel (ATC) is created by a passage in the hearing aid's main section (1).

21. A hearing aid in accordance with claim 20, characterized in that the acoustic transmission channel (ATC) has an equivalent diameter of 1-2 mm.

22. A hearing aid in accordance with claim 10, characterized in that the main section (1) is encapsulated in an adapter (5) for insertion in the outer meatus (6), and that the adapter (5) provides an individual adaptation to the shape of the meatus.

23. A hearing aid in accordance with claim 22, characterized in that the first microphone (M1) is mechanically connected to the main section (1) or its adapter (5).

24. A hearing aid in accordance with claim 10, characterized in that the battery (4) is attached to the outside of the main section (1) beside the outlet of the transmission channel (ATC) in the ear opening.

25. A hearing aid in accordance with claim 24, characterized in that the battery (4) is a rechargeable battery.

26. A hearing aid in accordance with claim 10, characterized in that the analog input section, the digital signal processor (DSP), the analog output section, the cycle generator (CG) and the control unit (CU) are implemented as a monolithic integrated circuit (3), preferably in CMOS technology.

27. A method for detection and signal processing in a programmable hybrid hearing aid with a main section (1) and a secondary section (2), wherein the main section, preferably in the form of an earplug, can be inserted principally in the outer meatus (6) of a person and has provided two microphones (M1, M2) and a sound generator (SG) and preferably also a battery (4), and wherein the hearing aid comprises an open connection between the ear opening and an inner portion of the outer meatus (6) preferably provided in the main section (1), characterized in that the open connection is adapted to the person's hearing in order to create an acoustic transmission channel with a low-pass characteristic, in that the transmission channel acts as a resonant acoustic amplifier in a frequency range whose upper critical frequency is preferably 150–200 Hz, and that the method comprises steps for a) detecting an external sound field together with an acoustic feedback signal from the sound generator through the transmission channel with the two microphones arranged at a distance from each other, the first microphone being provided at a suitable place in the concha and the other microphone at the outlet of the transmission channel in the ear opening, b) compensating for impairment of the feedback acoustic signal during the propagation between the outlet of the transmission channel and the first microphone by giving the second microphone a lower level of sensitivity than the first, the difference in sensitivity being proportional to the impairment, c) generating two microphone signals $s_1$, $s_2$ which are conveyed to a first and second channel respectively, d) amplifying each of the generated microphone signals $s_1$, $s_2$ in a microphone amplifier in the respective channel, e) compressing each of the amplified microphone signals $s_1$, $s_2$ dynamics to 60 dB or less in each channel, f) filtering each of the compressed microphone signals $s_1$, $s_2$ in a low-pass filter in each channel, that the filter's critical frequency preferably being 8 kHz, g) sampling the filtered microphone signals $s_1$, $s_2$ with a sampling frequency at least twice the low-pass filter's critical frequency, preferably 16 kHz, the sampling of the second filtered microphone signal $s_2$ being delayed by a period $\Delta t$ corresponding to the propagation time difference for the feedback acoustic signal between the microphones, thus generating a feedback-compensated spectral signal $s_0$, h) converting the spectral signal $s_0$ to a digital spectral signal s(t), preferably with 12 bits, i) generating an envelope signal e(t) for s(t) as a band-limited signal, preferably with 4–6 bits and a band width less than approximately 50 Hz, preferably 30 Hz, and then generating a quotient signal f(t) with band width 150–8000 Hz by performing the division $s(t)/e(t)=f(t)$, after which each of the signals e(t) and f(t) is conveyed to a first and a second signal path respectively, e(t) representing the amplitude component and f(t) the frequency component of the spectral signal s(t), j) compressing the envelope signal e(t), preferably to approximately 30 dB, in a compressor in the form of a filter in the first signal path, k) rounding the quotient signal f(t), preferably to 6 to 8 bits, l) filtering the quotient signal f(t) in a filter network in the second signal path, the filtering comprising compressing f(t) and modifying its frequency response curve, generating an optimum frequency response curve for f(t) with simultaneous correction of both its phase and amplitude as well as stabilizing the generated, optimum frequency response curve by removing fluctuations caused by the use of predetermined filter coefficients in the filter network, m) cancelling any residue of the feedback acoustic signal in f(t) in connection with the stabilization of the optimum frequency response curve, n) compensating for non-linearities in the filtered quotient signal f(t), the compensation of non-linearity preferably being performed by means of a table stored in a compensation circuit, o) converting the envelope signal e(t) into a pulse-width modulated signal with a sampling frequency, p) converting the compensated quotient signal f(t) into a pulse-height modulated signal with a sampling frequency, and q) multiplying the pulse-width modulated signal e(t) by the pulse-height-modulated signal f(t) in order to generate the processed spectral signal s(t), after which the product $s(t)=e(t)\cdot f(t)$ is converted into an analog output signal $s_r$ which is smoothed and transmitted to a sound generator for conversion to an acoustic output signal which essentially reproduces the external sound field detected by the microphones (M1,M2).

28. A method in accordance with claim 27, characterized in that the converted product $e(t)\cdot f(t)$ is given a power level which is sufficient to allow the analog output signal to drive the electrodynamic sound generator without further amplification.

29. A method in accordance with claim 27, characterized in that the quotient signal f(t) is compressed to 6 bits.

30. A method in accordance with claim 29, characterized in that the quotient signal f(t) is given a lower critical frequency adapted to the upper critical frequency of the acoustic transmission channel.

31. A method in accordance with claim 27, characterized in that the compensation of non-linearities in the filtered quotient signal f(t) particularly involves pre-compensation for distortion of the analog output signal $s_r$ which is generated by conversion of the digital spectral signal s(t) or its components e(t) and f(t), and the acoustic output signal from the sound generator.

32. A method in accordance with claim 27, characterized in that the output level of the spectral signal s(t) is tuned, in that the tuning is either performed digitally as an arithmetical operation on the envelope signal e(t), preferably by referring to a stored table immediately before it is converted to a pulse-width-modulated signal, or by multiplying the pulse-width-modulated envelope signal e(t) by a selectable factor k immediately before the multiplication e(t)·f(t) takes place.

33. A method in accordance with claim 32, characterized in that any drop which may occur in the battery voltage being compensated for in connection with the tuning of the output level of the spectral signal s(t).

34. A method in accordance with claim 27, characterized in that the filter network is implemented with separate filters for compression, equalization and stabilizing-/cancellation respectively.

35. A method in accordance with claim 34, characterized in that the transfer function of the filter network can be altered by providing the individual filters with different sets of filter coefficients, thus altering the transfer function of the individual filter.

36. A method in accordance with claim 35, characterized in that a specific transfer function of the filter network in the first signal path and the compressor in the second signal path respectively having a corresponding predetermined response function for the hearing aid, the response functions being generated by providing the individual filters with predetermined sets of filter coefficients stored in a random access memory contained in a control unit which is connected to the filter network.

37. A method in accordance with claim 36, characterized in that the number of predetermined response functions is at least 5.

38. A method in accordance with claim 37, characterized in that a desired response function being selected by means of an external control device via a cycle generator connected to the control unit.

39. A method in accordance with claim 37, characterized in that at least one predetermined response function comprises cancellation of the feedback acoustic signal in connection with stabilizing of the equalized quotient signal f(t).

40. A method in accordance with claim 39, characterized in that at least one predetermined response function or functions comprise adaptive cancellation of the feedback acoustic signal.

41. A method in accordance with claim 38, characterized in that the predetermined response functions only involve cancellation of the feedback acoustic signal if the response functions give an amplification of over 55 dB.

42. A method in accordance with claim 37, characterized in that the predetermined response functions also involve precompensation for distortion of the analog output signal $s_r$ and the acoustic output signal from the sound generator, together with tuning of the output level of the spectral signal s(t), the compensation and tuning parameters being preferably obtained by reference to tables stored in the respective random-access memories.

43. A method in accordance with claim 37, characterized in that the individual filters are implemented as programmable filters, each with its random-access memory, reprogramming being performed by supplying the random-access memory provided in the control unit which is connected to the individual filters' random-access memories, with one or more new sets of filter coefficients corresponding to one or more altered response functions.

44. A method in accordance with claim 43, characterized in that the control unit's random-access memory is supplied with one or more of the new sets of filter coefficients from a random access memory provided in the secondary section and which constitutes a backup memory for the control unit's memory and is also connected to an interface which can be connected to an external computer, preferably a personal computer, for predetermination or calculation of new sets of filter coefficients.

45. A method in accordance with claim 44, characterized in that the predetermined sets of filter coefficients which generate a specific response function, are determined on the basis of audiometric examinations of the person and acoustic parameters which represent a specific external acoustic environment, the result of the said examinations and the acoustic parameters being evaluated by means of the external computer.

* * * * *